United States Patent [19]

Lowe et al.

[11] 4,318,502

[45] Mar. 9, 1982

[54] BACK PACK HAVING A RELEASABLE CLIMBING HARNESS

[75] Inventors: Greg E. Lowe, Ogden, Utah; Michael R. Lowe, Eldorado Springs, Colo.

[73] Assignee: Lowe Alpine Systems, Inc., Lafayette, Colo.

[21] Appl. No.: 967,655

[22] Filed: Dec. 8, 1978

[51] Int. Cl.[3] ..... A45F 3/10

[52] U.S. Cl. ..... 224/153; 224/211; 224/226

[58] Field of Search ..... 224/209, 210, 208, 211, 224/212, 213, 214, 215, 216, 222, 202, 204, 257, 259, 261, 262, 263, 151, 153, 155, 224, 226; 244/151 R, 151 A, 143; 182/3, 6, 5, 7; 24/73 PH

[56] References Cited

U.S. PATENT DOCUMENTS

| | | | |
|---|---|---|---|
| 2,417,168 | 3/1947 | Kalnitz | 244/151 A |
| 3,132,779 | 5/1964 | Gray | 224/267 |
| 3,516,586 | 6/1970 | Farnbach | 224/262 |
| 3,757,893 | 9/1973 | Hobbs | 182/6 |
| 3,840,162 | 10/1974 | Horenstein et al. | 224/262 |

FOREIGN PATENT DOCUMENTS

| | | | |
|---|---|---|---|
| 915402 | 7/1946 | France | 244/151 R |
| 1057482 | 3/1954 | France | 244/151 R |

*Primary Examiner*—David A. Scherbel
*Assistant Examiner*—Edward M. Wacyra
*Attorney, Agent, or Firm*—O'Rourke and Harris

[57] ABSTRACT

A back pack having an enclosed volume suitable for storing and transporting materials, the back pack including shoulder straps and a belt for supporting the back pack upon a wearer, the belt constituting a climbing harness with attached, preferably storable, groin straps and a releasable attachment to the back pack.

10 Claims, 3 Drawing Figures

BACK PACK HAVING A RELEASABLE CLIMBING HARNESS

BACKGROUND OF THE INVENTION

1. Field of the Invention

The present invention relates generally to back packs for the transporting of supplies and equipment under adverse or demanding circumstances, the back pack including a body harness employable in mountain climbing operations and aerial evacuation which, while serving the conventional purpose of supporting the back pack, includes release means and storable groin straps to provide a climbing or evacuation harness. The harness may also include storage pockets or other means for carrying emergency stores or equipment.

2. Description of the Prior Art

Back packs have evolved through the years into means for comfortably and efficiently carrying considerable weight in supplies and equipment over long distances or rough terrain. Several features are found in common on most popular packs; these include means for properly distributing pack and load weight to the skeletal frame of the wearer, usually through a combination of shoulder straps and waist belt, and a basic rigid framework or internal stiffeners to maintain overall insight transfer to wearer and pack shape through varying load situations. Separately accessible compartments sized ad shaped to contain necessary equipment are also typical features of the modern back pack. Pack dimensions, methods of construction, materials, and strap and stiffener placement have been optimized through experimentation and design parameters are well established.

As an independent consideration, body harnesses, of the type often employed by mountain climbers as a means of attaching themselves comfortably and reliably to a supporting rope, and also used in military operations for the purpose of aerial extraction and evacuation of personnel, are likewise well-evolved and thoroughly researched devices. The harness usually comprises a high strength waist support attached to groin straps to insure proper position and weight support. Loops of webbing or similar means are provided for the purpose of attaching ropes or rigging to the harness, by, for example, a carabiner. Heretofore, climbing harness and other such gear had been normally carried in a back pack and employed only during climbing, evacuation or other such procedures. A certain degree of inconvenience unavoidably attends the wearing of both pack and separate climbing harness, and a penalty in weight must also be paid. Also, a back pack can constitute a considerable handicap if the wearer should unexpectedly come upon an emergency situation. In a military encounter, the back pack must be preserved to secure the benefit of the gear therein, such as the evacuation harness. Similarly, in a climbing or rescue situation, the wearer may be exposed to unexpected hazards while wearing, for the purposes of climbing, the cumbersome back pack.

SUMMARY OF THE INVENTION

The present invention, which provides a heretofore unavailable improvement over previous separate back pack and harness arrangements, comprises a waist strap of belt fitted with groin straps and webbing loops for attachment of ropes and which attaches to a back pack in a releasable manner and functions as an integral part thereof. The particular method of attachment of the harness portion of the apparatus to the back pack permits rapid and convenient detachment of the pack from the harness without disruption of the lifting or belaying functions of the harness, thereby making the pack and harness apparatus especially useful in emergency situations and in military operations. The back pack, with its cargo, may be quickly jettisoned or put aside for retrieval in the interests of freedom of movement and increased speed while the individual retains the capacities of the harness should lifting or safety lines be required.

Accordingly, an object of the present invention is to provide a new and improved method and construction for providing in a back pack the function of a climbing harness so that the back pack may be rapidly and conveniently converted to the climbing harness.

Another object of the present invention is to provide a new and improved method for securing a back pack to a harness such that under emergency conditions, as for example in a military situation, the pack may be easily and quickly released and abandoned while the harness, with essential survival equipment stored in belt pockets may be retained to assist the wearer in climbing operations or aerial evacuation procedures.

Yet another object of the present invention is to provide a back pack having an integral harness which may function selectively as climbing and evacuation gear or as a support for the back pack with attendant savings in weight and space.

These and other objects and features of the present invention will become apparent from the following description.

DETAILED DESCRIPTION OF THE INVENTION

Figure 1:
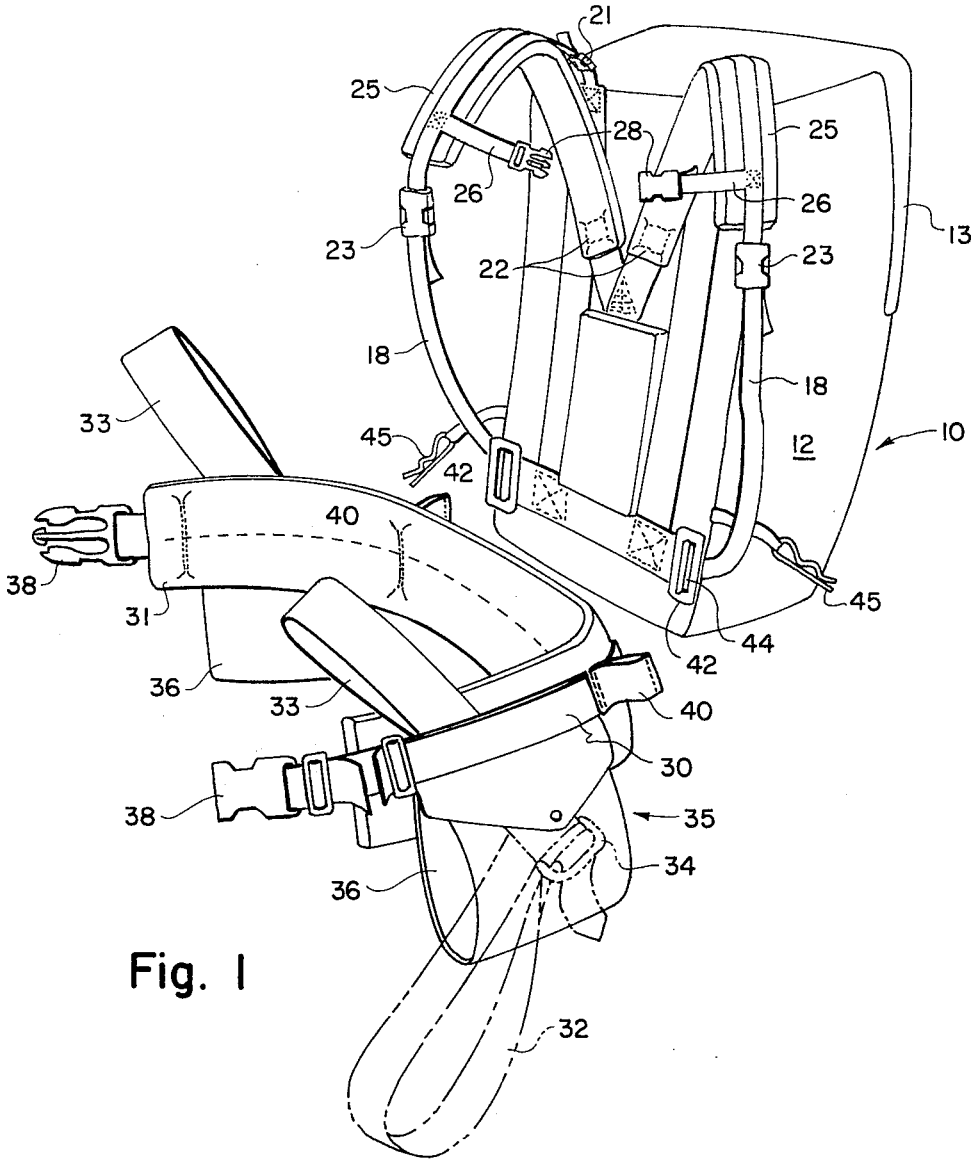
FIG. 1 is a front perspective view of a back pack and adjacent detached harness according to the instant invention, with groin straps and lifting loops deployed.
Figure 2:
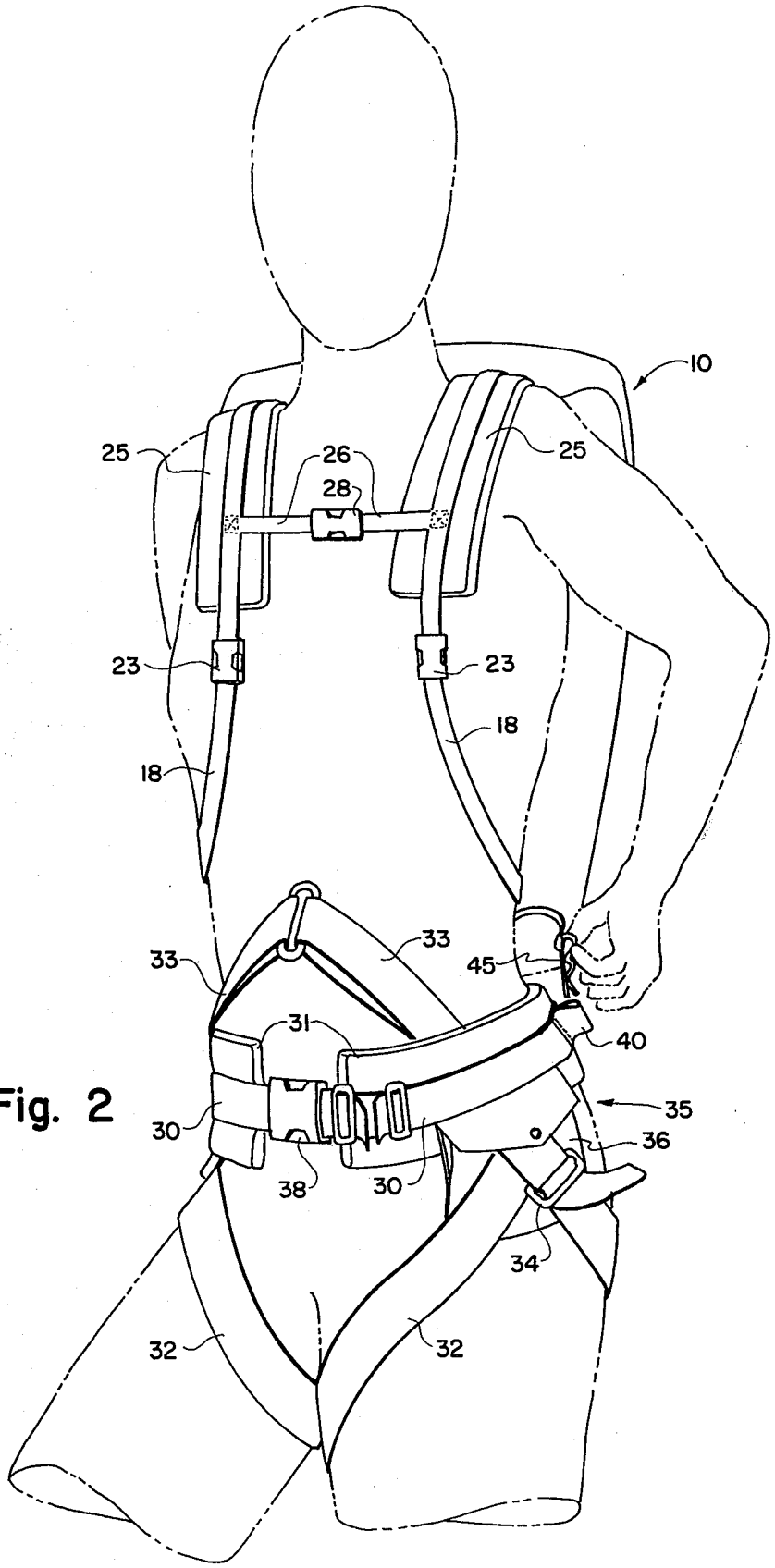
FIG. 2 is a side view of a back pack and climbing harness on a wearer illustrating the attachment of the shoulder, waist and groin straps.

Referring now to the drawings, wherein like components are designated by like reference numerals throughout the various figures, a back pack with releasable harness are shown in FIGS. 1 and 2 and collectively designated by reference numeral 10. Back pack 12 is, as illustrated, primarily formed of a pliable fabric which is water proof, or at least water resistant, and of substantial strength. A relatively heavy coated nylon or canvas are examples of such material.

As illustrated, back pack 12 includes a main compartment portion closed and covered by attached flap 13. Within flap 13 a subcompartment may be included, accessed through zipper closure and suited to the purpose of making a certain portion of the pack contents easily reachable by the wearer. The compartmental arrangements of pack 12 as illustrated are the preferred embodiment but should not be construed as essential for the overall function of the pack and harness structure 10. Various other arrangements of pack space would serve equally well and have no material effect on the operation of pack and harness assembly 10.

Shoulder straps 18, fashioned of suitably strong webbing material as, for instance, nylon, are adjustably attached to pack 12 by means of buckles 21 as well as sewn thereto at interface 22. Releasable and adjustable buckles 23 on straps 18 enable adjustment of straps 18 to suit wearers of various stature while providing for quick release of pack 12. Pads 25, fixed to straps 18, provide cushioning against the shoulders of the wearer. A chest strap 26, with adjustable and releasable buckles 28, connects shoulder straps 18 across the front of the wearer's chest, as illustrated in FIG. 2, helping to locate straps 18 properly and to transfer a portion of the pack weight to the wearer's skeletal structure through the sternum. The arrangement and detail of the shoulder straps 18 and their attendant adjustments and closures are shown here in the preferred embodiment. Similar arrangements of straps to back pack and back pack to wearer would function equally well and would neither enhance nor degrade the novel operation of the pack and harness system.

Waist belt 30, together with groin straps 32 and support loops 33, comprise the harness subassembly 35, as illustrated in FIGS. 1 and 2. Belt 30, of a suitably strong webbing material and preferably padded with pads 31 along the interior surface, carries groin straps 32 affixed at one end near the front portion of the belt. Groin straps 32 are positioned such that they may be passed between the wearer's legs and attached to the back portion of belt 30 by means of adjustable buckles 34. Pockets 36, attached to either side of belt 30, serve the dual purposes of providing storage of groin straps 32 when their use is not required and allowing survival equipment to be retained when the main pack is released. Additional pockets or equipment attachment means (not shown) may be included on belt 30 as desired. Support loops 33, constructed also of a suitably strong webbing, are firmly affixed at both ends to belt 30 providing simple and secure attachment of ropes and other types of rigging. Loops 33 are, as shown in FIG. 2, preferably aligned with groin straps 32 to efficiently and comfortably support a wearer "sitting" in groin straps 32 while secured by loops 33. Belt 30 is closed and adjusted to the waist of the wearer by means of adjustable buckle 38, preferably located at or near the front of the belt.

Figure 3:
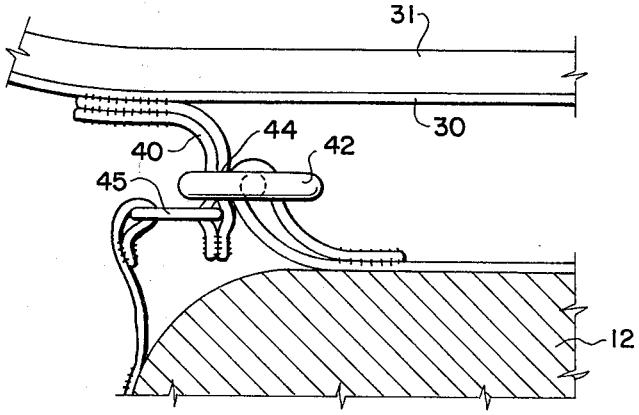
FIG. 3 is a detailed top view of the attachment means of the back pack to the harness.

Releasable means for connecting belt 30 to the main pack section of pack 12 may, as shown in FIG. 3, consist of loops 40, fashioned of high strength webbing material like or similar to that used in the various other straps and belts already described. Loops 40 are securely fastened to the rear portion of belt 30, at the outside surface of the belt. Openings in loops 40 are vertically oriented to facilitate introduction of the free ends of the loops into suitably positioned slots 44 in buckles 42 attached to pack 12. Insertion of loops 40 into vertical slots 44 on buckles 42, and subsequent locking of the loops into position by means of clip pins 45 inserted into loop ends on their emergence from slots 44, effectively join pack 12 and belt 30 so that belt 30 assumes the function of waist level support for the pack and its contents. Clip pins 45, preferably of a form that minimizes the possibility of accidental slippage or release, are attached to pack 12 with lanyards of webbing of the same type as used throughout the pack, lanyards being useful both to guard against inadvertant loss of pins 45 when the pack 12 and belt 30 are detached from one another and also to facilitate the locating and withdrawal of pins 45 in the event that the pack is to be released.

While the above description of the instant invention has been primarily with regard to preferred embodiments, it is of course contemplated that various other similar means may be employed. For instance, while a pack having integral supports is preferred for comfort, convenience and light weight, it would clearly be possible to employ packs without support, or in the form of an external frame having a pack thereon. In any instance, a belt is advantageously employed to assist in supporting the pack, and accordingly the advantages of the instant invention may be gained.

While the very simple pin and loop releasable means as described above is quite effective, reliable and light weight, various other releasable snaps and buckles, which are well known in the art, could of course be employed either, as described, on a multiple point releasable attachment basis, or with a single attachment point.

In certain instances, providing a back pack having thereon a belt with groin straps may be convenient and advantageous. However, in instances placing substantial demands upon the wearer, the releasable feature is much to be desired.

The advantages of the instant invention as described above will be appreciated with reference to the circumstances often encountered by, for instance, alpine rescue groups, military groups, particularly elite troops trained to operate behind enemy lines, and forest fire fighters. Common to individuals undertaking such demanding tasks is the need to carry adequate supplies to be self-sufficient for relatively extended periods. Particularly in the case of military personnel and forest fire fighters, it may be necessary to be rapidly evacuated by, for instance, a line from a helicopter. Also, technical climbing is not unusual during rescue situations in rough terrain.

From the above limited examples, it will be apparent that the advantages accruing from the instant invention afford efficiencies, economies of space and weight, and flexibility of use which may, in a number of situations, be critical to the safety or effectiveness of a mission. Of particular significance is the fact that the advantages are obtained with simple, uncomplicated mechanisms, in that the effectiveness of various components for one mode is not compromised by the fact that the components may also be collectively employed in other, alternative modes.

Although only limited embodiments of the present invention have been illustrated and described, it is anticipated that various changes and modifications will be apparent to those skilled in the art, and that such changes may be made without departing from the scope of the invention as defined by the following claims.

What is claimed is:

1. A back pack and support harness assembly comprising:

a storage enclosure assembly including an enclosure adapted to contain and protect material for transport and including shoulder strap means attached to the enclosure and adapted to secure the enclosure to the shoulder area of a wearer; and a support harness assembly comprising a belt member having groin straps depending therefrom with at least one end of each of the groin straps being fixedly attached to the belt member, at position spaced from the end portions thereof, the support harness assembly being releasably attached to the enclosure assembly by means manually releasable from the enclosure assembly whereby the support harness may be utilized as a belt member to assist in supporting the enclosure on a wearer or alternatively may be employed with the groin straps to support the wearer when suspended through the belt member from support means such as a rope.

2. A back pack and support harness as set forth in claim 1 in which the releasable means comprise a pin member, a first member secured to one of the enclosure assembly and support harness assembly having an opening defined therein adapted to receive the pin member, and a second member secured to the other of the enclosure assembly and support harness assembly and having an opening defined therein adapted to receive the first member, whereby the first member may be inserted into the opening defined in the second member and be retained therein by inserting the pin in the opening in the first member.

3. A back pack and support harness as set forth in claim 1 in which the groin straps are attached to the support harness assembly in a fixed manner at one end, attached to the support harness assembly with releasable means at the other end, and in which a pocket is attached to the support harness assembly adjacent to each groin strap and adapted to receive the groin strap for storage.

4. A back pack and support harness as set forth in claim 1 in which support loops are secured to an upper portion of the support harness assembly.

5. A back pack and support harness as set forth in claim 4 in which the support loops and groin straps at an attachment point thereof to the belt member are positioned in lengthwise alignment on opposite sides of the belt member, and the support loops are adapted to be positioned adjacent one another.

6. A back pack and support harness as set forth in claim 1 in which the support harness assembly comprises fastening means at the ends of the belt member, a pair of groin straps positioned symmetrically and attachable at both ends thereof to the lower portion of the belt member, adjustment means in each groin strap adapted to secure the groin members at various lengths, pocket structures secured to the belt member adjacent each groin strap and adapted to store the adjacent groin strap, and a pair of support loops attached to the upper portion of the belt member and aligned lengthwise with at least one end of an adjacent groin strap at the attachment point of the groin to the belt member.

7. A back pack and support harness assembly as set forth in claim 1 in which the storage enclosure assembly is formed of a pliable textile material at the enclosure portion thereof.

8. A back pack and support harness assembly comprising:

a storage enclosure formed of pliable material adapted to contain and protect material for transport;

shoulder strap means attached to the enclosure and adapted to secure the enclosure to the shoulder area of a wearer;

a support harness assembly including a belt member and a pair of groin straps attachable at the ends thereof to the belt member at positions spaced from the end portion thereof; and releasable fastening means securing the belt member to the enclosure to facilitate release of the enclosure and shoulder strap means from the support harness.

9. A back pack and support harness assembly as set forth in claim 8 in which the support harness assembly further includes a pair of support loops attached to the belt member and aligned lengthwise with a corresponding groin strap at a point of attachment of the groin strap to the belt member.

10. A back pack and support harness assembly as set forth in claim 8 in which the releasable fastening means comprise a pair of web loops attached to one of the belt members and enclosure, a pair of attachment members each having an opening defined therein adapted to receive a corresponding web loop therethrough attached to the other of the belt members and enclosure, and a pair of removable pin members fitted one each in the web loops to secure the web loops to the attachment members.

* * * * *

UNITED STATES PATENT AND TRADEMARK OFFICE

CERTIFICATE OF CORRECTION

PATENT NO. : 4,318,502

DATED : March 9, 1982

INVENTOR(S) : Greg E. Lowe et al.

It is certified that error appears in the above-identified patent and that said Letters Patent are hereby corrected as shown below:

Column 1, line 27, delete "insight" and substitute --weight--.

Signed and Sealed this

Sixth Day of July 1982

[SEAL]

Attest:

GERALD J. MOSSINGHOFF

Attesting Officer

Commissioner of Patents and Trademarks